US005921388A

United States Patent [19]

Petrilli et al.

[11] Patent Number: 5,921,388

[45] Date of Patent: Jul. 13, 1999

[54] QUICK DEPLOYMENT FIRE SHELTER

[75] Inventors: Anthony C. Petrilli, Missoula, Mont.; William B. Bickers, Redmond, Oreg.

[73] Assignee: The United States as represented by the Secretary of Agriculture, Washington, D.C.

[21] Appl. No.: 09/199,610

[22] Filed: Nov. 25, 1998

[51] Int. Cl.[6] ..... B65D 83/00

[52] U.S. Cl. ..... 206/321; 206/315.1; 206/494

[58] Field of Search ..... 206/577, 223, 206/541, 321, 315.1, 494; 224/196

[56] References Cited

U.S. PATENT DOCUMENTS

| | | | |
|---|---|---|---|
| 3,471,007 | 10/1969 | Sherman | 206/321 |
| 3,908,937 | 9/1975 | Poynter . | |
| 4,858,797 | 8/1989 | Rabska . | |
| 4,943,252 | 7/1990 | Manix . | |
| 5,033,497 | 7/1991 | Hernandez | 206/315.1 |
| 5,341,973 | 8/1994 | Dawes et al. . | |
| 5,619,955 | 4/1997 | Nelson . | |

OTHER PUBLICATIONS

"Your Fire Shelter", USDA Forest Service, 9551–2819–MTDC Apr., 1995.

"Your Fire Shelter Beyond the Basics", USDA Forest Service 9651–2829–MTDC, Jun., 1996.

*Primary Examiner*—Jacob K. Ackun

*Attorney, Agent, or Firm*—Janet I. Stockhausen; M. Howard Silverstein; John D. Fado

[57] ABSTRACT

A rapidly deployable fire shelter employs a flexible web handle attached directly to a protective pouch holding the folded fire shelter. The handle includes opposed fastener surfaces that may be interposed between the closure normally holding the cover to the protective pouch. The handle extends outside the pouch to be grasped by the firefighter and pulled so as in a single motion to release the cover from the pouch and extract the fire shelter without loss of control of the fire shelter.

6 Claims, 2 Drawing Sheets

QUICK DEPLOYMENT FIRE SHELTER

CROSS-REFERENCE TO RELATED APPLICATIONS

STATEMENT REGARDING FEDERALLY SPONSORED RESEARCH OR DEVELOPMENT

BACKGROUND OF THE INVENTION

A fire shelter is a compact, tent-like structure providing emergency protection to a firefighter entrapped by an advancing forest fire. The fire shelter is constructed of a heat-reflecting foil bonded to the outside of a fiberglass cloth or the like. The combination of materials allows the fire shelter to be accordion folded into a compact brick that may be carried with the firefighter at all times. The fire shelter is deployed by unfolding it into the shape of a triangular prism or pup tent. The shelter is greater in length than the height of a fire fighter and open at the bottom, except for restraining straps, and enclosed along its remaining four faces. The firefighter uses the fire shelter by lying face down on the restraining straps with the walls of the fire shelter enclosing the firefighter's body as separated by an insulating air space. More information on the fire shelter and its use is contained in "Your Fire Shelter" and "Your Fire Shelter","Beyond the Basics" published by the United States Department of Agriculture, Forest Service, Technology and Development Program, under Codes NFES 1750 and 2179, hereby incorporated by reference.

In order to protect the fire shelter during prolonged periods of storage, it is sealed in a vinyl envelope having pull tabs that may be used to tear the envelope open when the fire shelter is needed. The vinyl envelope and fire shelter are further protected from abrasion and damage by a surrounding rigid sleeve which in turn is contained in a fabric pouch of material similar to that used for backpacks and the like. The pouch has a hinged flap providing a cover which may be fastened closed with Velcro-type strips attached to the flap and pouch. The fire shelter pouch is required as part of the firefighter's regular personal protective equipment, either attached to the firefighter's belt or the firefighter's backpack.

A fire shelter is inevitably deployed under emergency situations and time is frequently of the essence. Ideal deployment is in an area removed from large amounts of combustible material. For this reason, the initial stages of deployment may occur while the firefighter is running to a safe deployment area. At this time, the removal of the fire shelter may be hampered by the firefighter's dropping of his or her backpack to obtain greater mobility and to jettison dangerous combustible materials such as fuses.

When the flame front passes over the fire shelter, the corners of the fire shelter can lift up under the force of flame-induced winds. Gloved hands are needed to hold these corners down. For this and other reasons, it is desirable that the firefighter be able to deploy the fire shelter with gloved hands.

Rapid deployment of a fire shelter is not always possible. On the Dude and California fires in 1990, people trying to escape entrapment tried to deploy fire shelters on the run. They were unable to do so, and at least six people were caught by the flame front before they could fully deploy their shelters. None survived.

Accordingly, it is desirable to provide a fire shelter that is easier and faster to deploy.

SUMMARY OF THE INVENTION

The present invention permits rapid, one-handed deployment of a fire shelter with reduced risk that the fire shelter will be dropped while providing an improved ability to release the fire shelter from its vinyl bag.

Generally, a handle is attached to the fire shelter and is threaded between the Velcro closure of the pouch. Pulling the handle at once opens the pouch and extracts the fire shelter. In one embodiment, the handle may be affixed to the vinyl envelope aiding in opening the envelope with gloved hands. In another embodiment, the handle may be attached directly to the fire shelter at a point which allows more efficient unfolding of the shelter with gloved hands once the fire shelter is removed from the vinyl envelope.

Specifically, the present invention provides a rapidly deployable fire shelter having a fire shelter unit (e.g., the folded fire shelter and its vinyl envelope) fitting within an outer protective pouch. The open end of the pouch includes a cover detachably covering the open end and retained by a releasable fastener attaching the portion of the cover to a portion of the pouch. A handle is attached at one end to the fire shelter so that when the fire shelter unit is received within the pouch and the cover is in place over the opening, the handle extends out of the pouch adjacent to the releasable fastener to present an exposed end to the user.

It is one object of the invention to provide a fire shelter that may be rapidly removed from a protective pouch in a single-handed operation. Pulling the handle simultaneously opens the pouch and extracts the fire shelter. The firefighter retains control of the fire shelter so long as the handle is grasped, and a second hand is not needed to catch the fire shelter to keep it from falling free to the ground.

It is another object of the invention to provide a single motion deployment of the fire shelter. The handle and fire shelter pull free from the pouch, and therefore the firefighter need not move his or her grip or release the handle in order to abandon the backpack to which the pouch may be attached. The fire shelter may be released and extracted and the backpack quickly jettisoned without further operations.

As mentioned, the fire shelter unit may include a folded fire shelter sealed in a protective envelope, and the handle may be attached to the protective envelope to be separate from the fire shelter.

Thus, it is another object of the invention to provide a single handle attached to the fire shelter that may be easily held in a gloved hand to both extract the fire shelter and aid in the tearing of the protective envelope covering the fire shelter.

The handle may be a flexible strap and the releasable fastener may include first fastener halves attached to the pouch and cover. The handle may include second fastener halves whereby the handle may be interposed between the releasable fastener with the first fastener half of the pouch releasably attached to one second fastener half of the handle, and the remaining second fastener half of the handle releasably attached to the first fastener half of the cover.

Thus, it is yet another object of the invention to integrally incorporate the handle into the closure mechanism of the pouch, both to ensure proper releasing of the pouch when the handle is pulled and to reliably locate the handle against movement.

It is yet another object of the invention to limit the possibility of accidental deployment, by attaching the handle twice to the pouch—once directly and once via the cover which in turn may be connected to the pouch.

The foregoing and other objects and advantages of the invention will appear from the following description. In the description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

DETAILED DESCRIPTION OF THE PREFERRED EMBODIMENT

Figure 1:
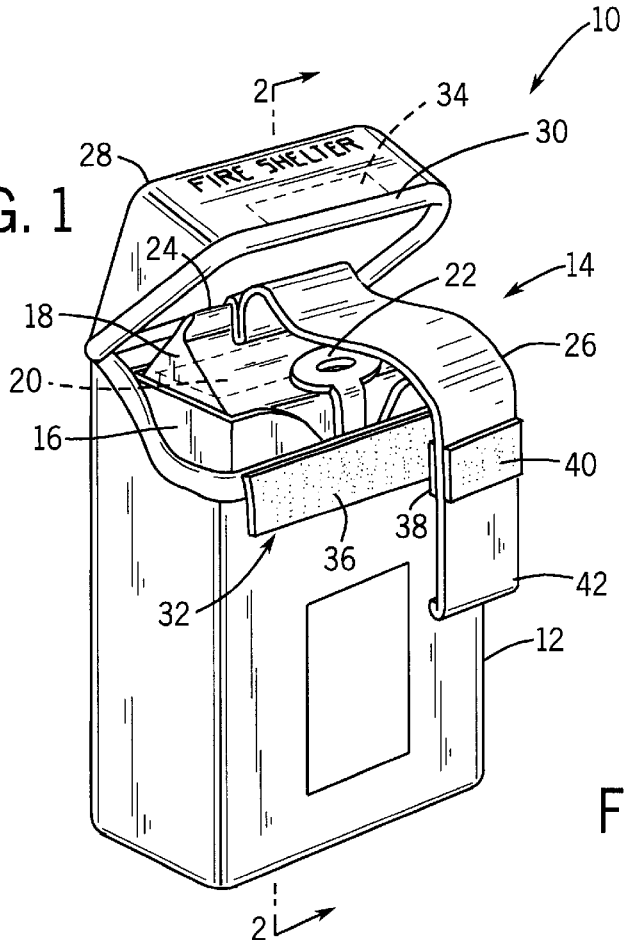
FIG. 1 is a perspective view of a protective pouch having an attached cover and holding a fire shelter, the latter contained in a protective vinyl bag having an attached extraction handle per the present invention.

Referring now to FIG. 1, a fire shelter assembly 10 includes an outer pouch 12 constructed of nylon duck or the like to provide a generally rectangular volume having an open end 14. A rigid plastic sleeve 16 fits within the pouch 12 so as to support the pouch 12 against a crushing of its contents. Fitting within the sleeve 16 is the vinyl bag 18 holding within it the fire shelter 20.

As is understood in the art, the vinyl bag 18 includes pull tabs 22 which may be grasped by the firefighter to rip open the vinyl bag 18 after it is removed from the pouch 12 to thereby free the fire shelter 20. The upper edge of the vinyl bag 18 is heat-sealed to prevent moisture and other contaminants from contacting the contained fire shelter 20 and produce a lip 24 to which one end of a nylon web 26 may be sewn. Sewing the nylon web 26 to the lip 24 provides a broad-area attachment between the nylon web 26 and the vinyl bag 18 to minimize the chance of a tearing of the vinyl bag 18 from force applied by the nylon web 26. The vinyl bag 18 is placed in the pouch 12 with the lip 24 extending from the open end 14.

A cover 28 constructed of the same material as the pouch 12 is sewn along a rear hinging edge to the rear edge of the open end 14 of the pouch 12 so as to move freely between an open position (shown in FIG. 1) and a closed position (shown in FIG. 2) where a front lip 30 of the cover 28 passes over a front edge 32 of the pouch 12. Sewn to an inner surface of the front lip 30 of the cover 28 is hook material 34 such as forms part of a hook-and-loop fabric fastener such as sold under the trade name of Velcro. Corresponding loop material 36 is sewn to the outer surface of the front edge 32 of the pouch 12.

Figure 2:
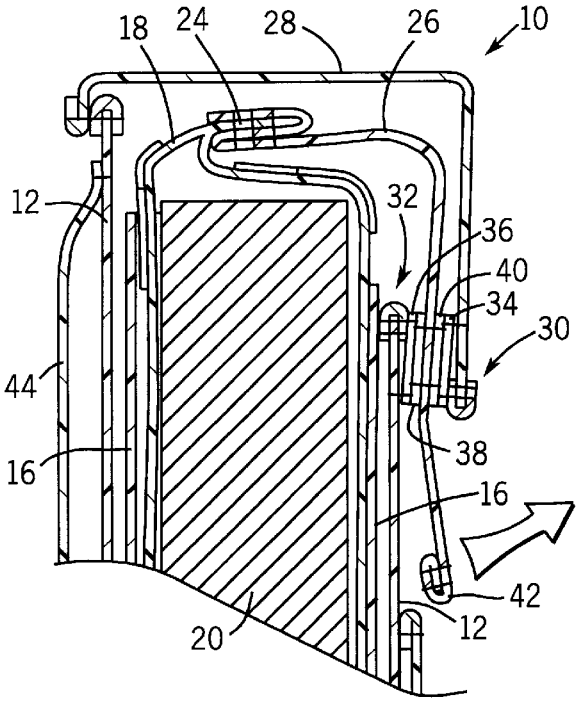
FIG. 2 is a fragmentary cross-section taken along line 2—2 of FIG. 1 showing the pouch of FIG. 1 when closed, prior to deployment, and showing the interfitting of the handle between fasteners of the pouch and cover to engage those surfaces so as to hold the cover closed and to retain the fire shelter in the pouch.

Referring now to FIGS. 1 and 2, the nylon web 26 extends upward from the lip 24 of the vinyl bag 18, as contained in the pouch 12, and may be folded forward and then downward to pass over the front edge 32 of the pouch 12. At that point of crossing, hook material 38 may be attached to the nylon web 26 immediately adjacent to the loop material 36 so as to fasten the nylon web 26 releasably against the front edge 32 of the pouch 12.

The cover 28 may then be closed as shown in FIG. 2 so that the front lip 30 lies over top of the front edge 32 of the pouch 12, sandwiching the nylon web 26 therebetween. To the portion of the nylon web 26 adjacent to the hook material 34 on the cover 28 is sewn loop material 40 so as to engage the hook material 34 on the cover 28 and to hold the cover 28 in a closed position via the interconnection of the nylon web 26 with the pouch 12. A handle portion 42 of the nylon web 26 may extend beyond the cover 28 to the outside of the pouch 12, permitting a firefighter to grasp the nylon web 26 at the handle portion 42 by sliding a gloved hand 52 along the front of the pouch 12.

Referring still to FIGS. 2, one or more belt or backpack hangers 44 may be attached to the rear side of the pouch 12 according to methods well known in the art, to suspend the pouch 12 from a belt or backpack.

Figure 3:
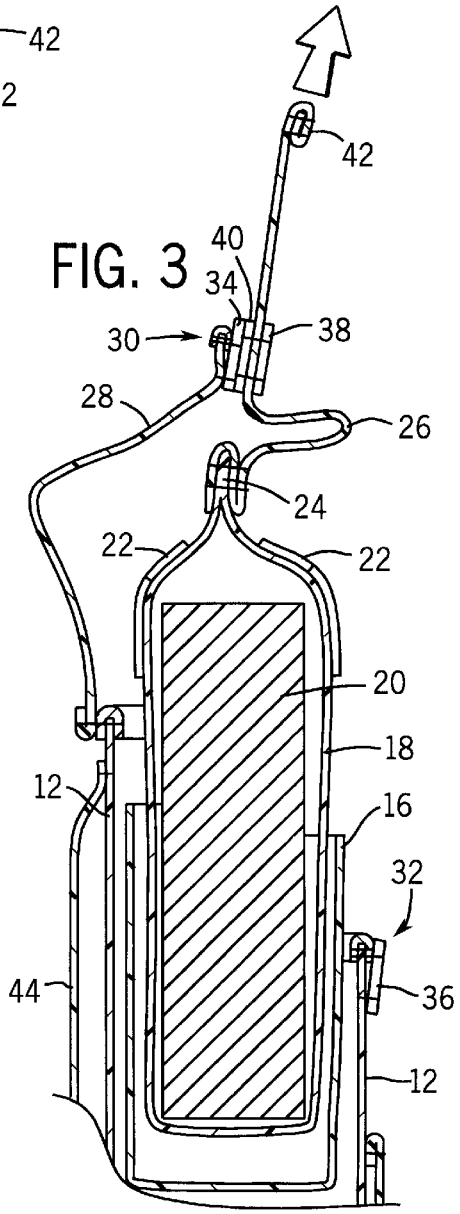
FIG. 3 is a figure similar to that of FIG. 2 showing a pulling outward of the handle during initial stages of deployment of the fire shelter so as to release the cover from the front edge of the pouch, extracting the fire shelter prior to release of the handle from the cover.

Referring now to FIG. 3, the handle portion 42 may be pulled away from the front edge 32 of the pouch 12 and outward toward the open end 14 of the pouch 12 so as to release the loop material 36 on the pouch 12, and forming half of a releasable connector from the hook material 38 on the nylon web 26, thereby opening cover 28 as shown in FIG. 3. Further outward motion of the handle portion 42 detaches loop material 40 attached to nylon web 26 from hook material 34 attached to the front lip 30 of the cover 28, wholly releasing the nylon web 26 from the cover 28 and pouch 12. Further outward motion completely extracts the vinyl bag 18 from the pouch 12 while maintaining the fire shelter 20 in control of the firefighter via the handle portion 42.

The web 26 and/or handle portion 42 may then be used as one point of purchase for the gripping and tearing away of pull tabs 22 at the site of deployment. At this time, the backpack holding the pouch 12 will have been abandoned and a second hand will be available.

Referring still to FIG. 3, in actual use, the fire shelter 20 does not come out of the sleeve 16 until hook material 34 and loop material 40 release, but is shown lifted from the sleeve 16 for clarity.

In the closed configuration of FIG. 2, prior to deployment, it will be understood that the vinyl bag 18 holding the fire shelter 20 is secured by two paths of contact to the firefighter, either directly to the pouch 12 (attached to the firefighter by belt loops or via the firefighter's backpack) or to the pouch 12 via the cover 28. Generally, the forces on the fire shelter 20 against the cover 28 during normal activity of the firefighter will act on the materials 34, 40, 38 and 36, in a shearing direction, against which such fasteners are strongest. In contrast, outward motion as indicated in FIG. 2 of the handle portion 42 peels away loop material 36 from hook material 38 in a manner requiring less force. Thus accidental deployment of the fire shelter 20 is reduced. The possibility of accidental opening of the cover 28 by handle portion 42 catching on brush or the like is further reduced by the smooth end of handle portion 42, which may be a rolled seam and the flexibility of the handle portion 42.

Further, should the cover 28 be accidentally opened, the fire shelter 20 will retain, for a period of time, its connection with the cover 28 through hook and loop materials 34 and 40, increasing the chance that such an accidental deployment will be detected and reducing the chance that the fire shelter 20 will simply fall out on the ground unnoticed.

Figure 4:
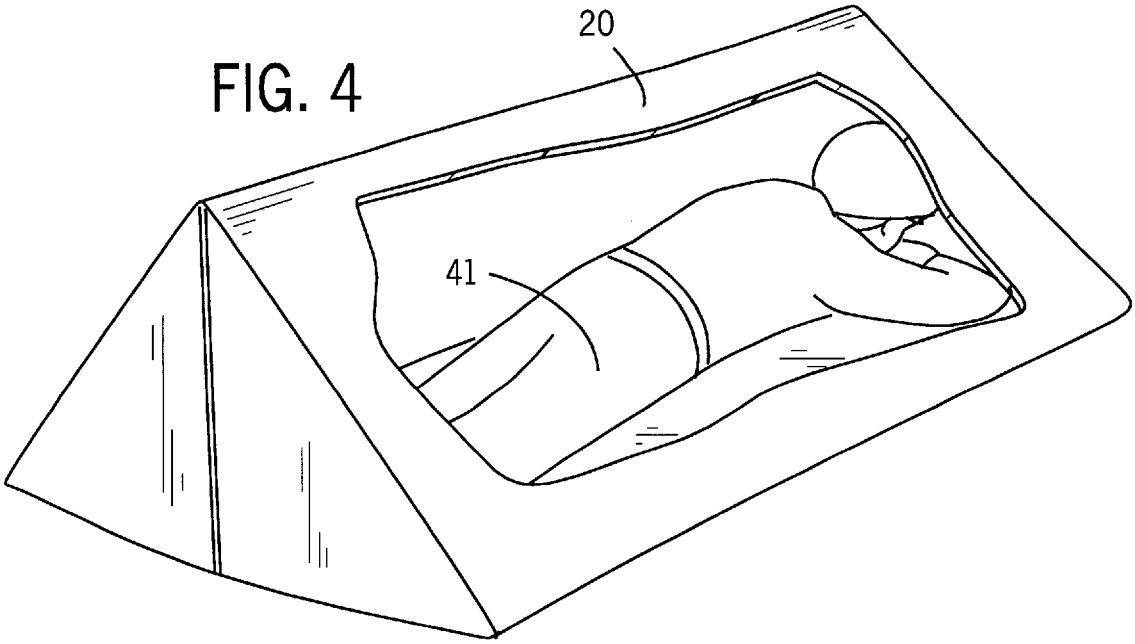
FIG. 4 is a perspective view in cut away of a deployed fire shelter with a person lying inside in the position one would normally assume upon shelter deployment.

Referring now to FIG. 4, a person 41 lying inside the fire shelter 20 would normally assume a prone position, with his face down and nose to the ground to protect his vulnerable lungs and airways. Shown also in FIG. 4 is a hardhat that keeps the shelter away from the firefighter's head; flame-resistant clothing that provides added insulation and secondary protection; and protective gloves 52 needed to restrain the lower edge of the hot shelter against induced winds.

Figure 5:
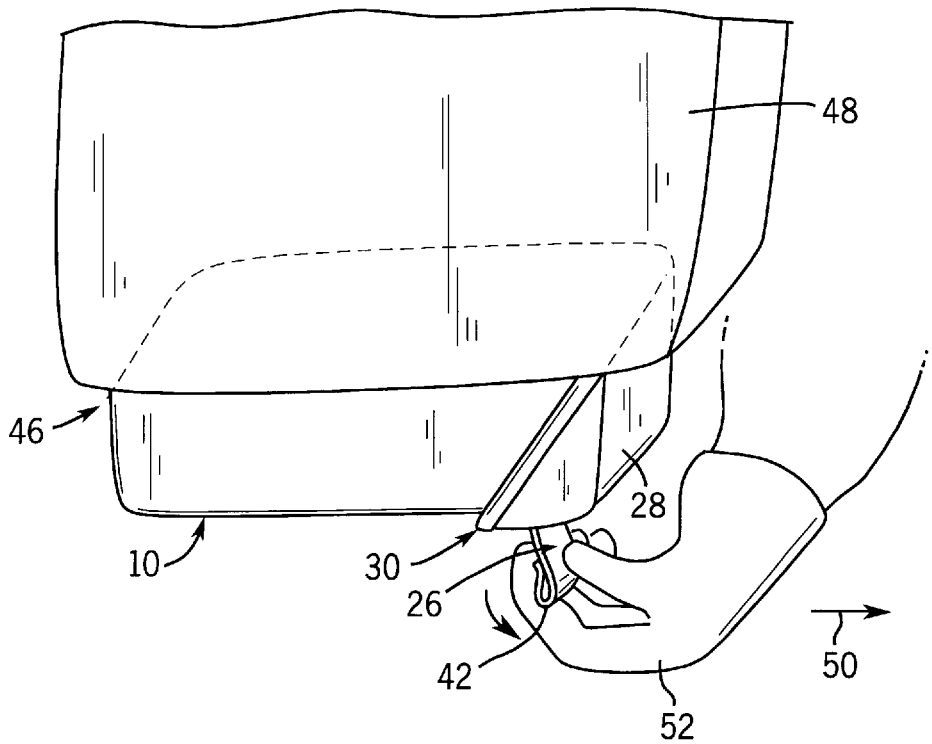
FIG. 5 shows the protective pouch of the present invention attached to a backpack, showing a pulling outward of the handle, prior to release of the handle from the cover.

Referring now to FIGS. 2 and 5, the pouch 12 may be attached to the lower surface 46 of a backpack 48, or the like, to be available to the firefighter at all times. A rear face of the pouch 12 abuts the lower surface of the backpack, as attached by the belt hangers 44 or by being sewn directly to the lower surface 46, thereby exposing the handle portion 42 of the nylon web 26 downward below the backpack 48. In this way, the firefighter, while wearing the backpack and running, may reach backward and sweep a gloved hand 52 in a lateral direction 50 below the backpack 48, thereby contacting the front surface of the pouch 12, to locate and grasp the handle portion 42 and release the fire shelter 12 in one motion with little risk, so long as the handle portion 42 is retained, of losing the fire shelter 20 onto the ground. The backpack 48 and pouch 12 may then be quickly discarded to improve the firefighter's mobility.

In an alternative embodiment not shown, the nylon web 26 may be attached through the vinyl bag 18 directly to a portion of the fire shelter 20 selected so as to provide an optimal point of purchase for unfolding the fire shelter 20 in an entrapment situation. The handle portion 42 and/or web 26 may be positioned to be outside the fire shelter 20 when it is deployed to prevent outgassing such as may contaminate the air within the shelter.

The above description has been that of a preferred embodiment of the present invention, it will occur to those that practice the art that many modifications may be made without departing from the spirit and scope of the invention. For example, the particular materials of nylon and vinyl may be substituted for other materials of known properties and the hook and loop fasteners replaced with other fastener types exhibiting similar properties. Further, the same invention may have application to other products in which positive retention of a packaged product is required together with rapid release.

In order to apprise the public of the various embodiments that may fall within the scope of the invention, the following claims are made.

We claim:

1. A fire shelter storage system allowing rapid deployment comprising:

a fire shelter unit;

an outer protective pouch sized to receive the fire shelter unit through an open end of the pouch, the pouch further including a cover detachably covering the open end as retained by a releasable fastener attaching a portion of the cover to a portion of the pouch; and a handle having one end attached to the fire shelter unit and sized so that when the fire shelter unit is received within the pouch and the cover is in place over the opening, the handle may extend out of the pouch adjacent to the releasable fastener to present an exposed end to a user;

whereby the fire shelter may be removed from the pouch by applying a force to the handle to release the releasable fastener and extract the fire shelter unit from the pouch.

2. The fire shelter storage system of claim 1 wherein the fire shelter unit includes a folded fire shelter sealed in a protective envelope and wherein the handle is attached to the protective envelope to be separate from the fire shelter.

3. The fire shelter storage system of claim 1 wherein the handle is a flexible strap.

4. The fire shelter storage system of claim 1 wherein the releasable fastener includes first fastener halves attached to the pouch and cover and wherein the handle includes second fastener halves whereby the handle may be interposed between the releasable faster with the first fastener half of the pouch releasably attached to one second fastener half of the handle and the remaining second fastener half of the handle releasably attached to the first fastener half of the cover.

5. The fire shelter storage system of claim 1 wherein the releasable fastener is a fabric hook and loop fastener.

6. The fire shelter storage system of claim 1 wherein the fire shelter unit includes a secondary rigid protective sleeve holding a folded fire shelter unit sealed in a protective envelope.

* * * * *